US005180115A

United States Patent [19]

Stein

[11] Patent Number: 5,180,115

[45] Date of Patent: Jan. 19, 1993

[54] TORQUE-TRANSMISSION DEVICE

[75] Inventor: Hans Stein, Hainburg, Fed. Rep. of Germany

[73] Assignee: E. I. Du Pont de Nemours and Company, Wilmington, Del.

[21] Appl. No.: 515,700

[22] Filed: Apr. 26, 1990

[30] Foreign Application Priority Data

Apr. 27, 1989 [DE] Fed. Rep. of Germany ..... 3913919

[51] Int. Cl.[5] ..... B65H 18/04

[52] U.S. Cl. ..... 242/56.9

[58] Field of Search ..... 242/56.9, 75.51; 464/29; 310/103, 106, 114, 191

[56] References Cited

U.S. PATENT DOCUMENTS

| | | | |
|---|---|---|---|
| 2,779,548 | 1/1957 | Helmer | 242/75.51 |
| 2,791,933 | 5/1957 | Crockett | 242/75.51 |
| 2,796,222 | 6/1957 | Frankel | 242/75.51 |
| 2,943,216 | 6/1960 | Spodig | 464/29 |
| 3,174,701 | 3/1965 | Frankel | 242/75.51 |
| 3,221,389 | 12/1965 | Cowell | 464/29 |
| 3,315,773 | 4/1967 | Aschauer | 464/29 X |
| 3,424,395 | 1/1969 | Schmidt et al. | 242/56.9 |
| 3,573,517 | 4/1971 | Osterstrom | 310/103 |
| 3,603,521 | 9/1971 | Ormsby | 242/56.9 X |
| 3,606,198 | 9/1971 | Gilbreath et al. | 242/75.51 X |
| 3,934,833 | 1/1976 | Nash et al. | 242/56.9 |
| 4,063,692 | 12/1977 | Buggy | 242/56.9 |
| 4,350,913 | 9/1982 | Eddens | 310/103 |
| 4,398,678 | 8/1983 | Kron et al. | 242/56.9 X |
| 4,497,455 | 2/1985 | Kampf et al. | 242/56.9 |
| 4,819,388 | 4/1989 | Kirkland | 310/103 X |
| 4,875,632 | 10/1989 | Kataoka | 242/56.9 X |

FOREIGN PATENT DOCUMENTS

| | | | |
|---|---|---|---|
| 2438830 | 3/1975 | Fed. Rep. of Germany | 310/103 |
| 3732766 | 4/1988 | Fed. Rep. of Germany | 310/103 |
| 61-69365 | 4/1986 | Japan | 310/103 |
| 854896 | 11/1960 | United Kingdom | 464/29 |

*Primary Examiner*—Daniel P. Stodola
*Assistant Examiner*—John P. Darling
*Attorney, Agent, or Firm*—Thomas H. Magee

[57] ABSTRACT

A winding device for simultaneously winding several widths of material onto reel cores has a driven reel axle on which at least one reel core is rotatably arranged, and has a torque-transmission device to transmit a torque from the reel axle to the reel core. The torque-transmission device has a sliding hub element disposed on the reel axle, and a core-receiving element which slides in the reel core and which is affixed in the reel core in the rotating and axial directions. The torque-transmission device is arranged in the radial direction between the reel axle and the reel core, and the hub element is attached to the reel axle in the axial direction. The torque-transmsision device generates a magnetic coupling field between the hub element and the core-receiving element which is sufficient to transmit a torque therebetween.

8 Claims, 2 Drawing Sheets

TORQUE-TRANSMISSION DEVICE

BACKGROUND OF THE INVENTION

1. Field of the Invention

This invention pertains to a winding device to simultaneously wind several widths of material, in particular photopolymer films, onto reel cores, having at least one driven axle on which the reel cores are rotatably arranged, and having a torque-transmission device to transmit a torque from the reel axle to the reel cores, and which has a sliding hub element on the reel axle and a core-receiving element which slides in the reel core and which can be affixed in the latter in the rotating and axial directions.

2. Description of Related Art

Longitudinal cutting machines unwind a width of material from a wide roll and cut it longitudinally into numerous parallel strips of material. At the same time the strips of material thus formed are wound onto reel cores. The individual reel cores can be arranged at intervals on a reel axle. As a rule, there are two reel axles, on which the individual reel cores are arranged staggered with respect to each other. It has proven practical not to drive the individual reel cores at identical rotation speeds. Consequently, the winding tension in each reel can adjust itself independent of the other reels, thus only being influenced by the torque driving that particular reel.

In a prior art device of this type, hub elements, core-receiving elements and spacing tubes are arranged alternately on the reel axle. The core-receiving elements and the spacing tubes can move freely on the reel axle, whereas the hub elements are rigidly attached to the reel axle, although they can be slid axially on bearings. The hub elements have a friction surface which rubs against the friction surface of the matching core-receiving element. The pressure necessary comes from a spring which is installed at one end of the shaft and which exerts pressure on all of the hub elements, core-receiving elements and spacing tubes on one reel axle between itself and a rigid support on the opposite end of the reel axle, which is in the form of a shaft. The magnitude of the transmitted torque is determined by the force exerted by the spring. In this process, the same torque is transmitted to all of the reels. Consequently, all strips of material must have the same width. Otherwise, the winding tension for a narrower strip would be greater than for a wider strip.

The rubbing of the friction surfaces against each other creates a fine dust, which makes it practically impossible to operate the prior art winding device under clean-room conditions without taking additional complex measures. However, clean-room conditions are indispensable, for example, in the manufacture of photopolymer films. Moreover, a change in the cutting program, that is, changing the width of the individual strips of material that are to be wound up, is extremely complicated. The reel axle has to be completely cleared and then retooled in order to ensure that the core-receiving elements, the hub elements and the spacing tubes are in the right position for transmission of the friction force and that a reel core is not coincidentially positioned on a spacing tube.

The object of the present invention is to provide a winding device which can be operated under clean-room conditions and which makes it possible to easily change the cutting program. This task is solved by a winding device of the type described above in that the torque-transmission device is arranged in the radial direction between the reel axle and the reel core, in that the hub element can be affixed in the axial direction on the reel axle, and in that one of the two parts has a device which serves to transmit a torque to the other part while maintaining clean-room conditions.

SUMMARY OF THE INVENTION

The present invention comprises a winding device for simultaneously winding several widths of material into reel cores. The device has a driven reel axle on which at least one reel core is rotatably arranged, and has a torque-transmission device to transmit a torque from the reel axle to the reel core. The torque-transmission device has a sliding hub element disposed on the reel axle and a core-receiving element which slides in the reel core and which is affixed in the reel core in the rotating and axial directions. The torque-transmission device is arranged in the radial direction between the reel axle and the reel core, and the hub element is attached to the reel axle in the axial direction. The torque-transmission device generates a magnetic coupling field between the hub element and the core-receiving element which is sufficient to transmit a torque therebetween.

DETAILED DESCRIPTION OF THE PREFERRED EMBODIMENTS

Figure 1:
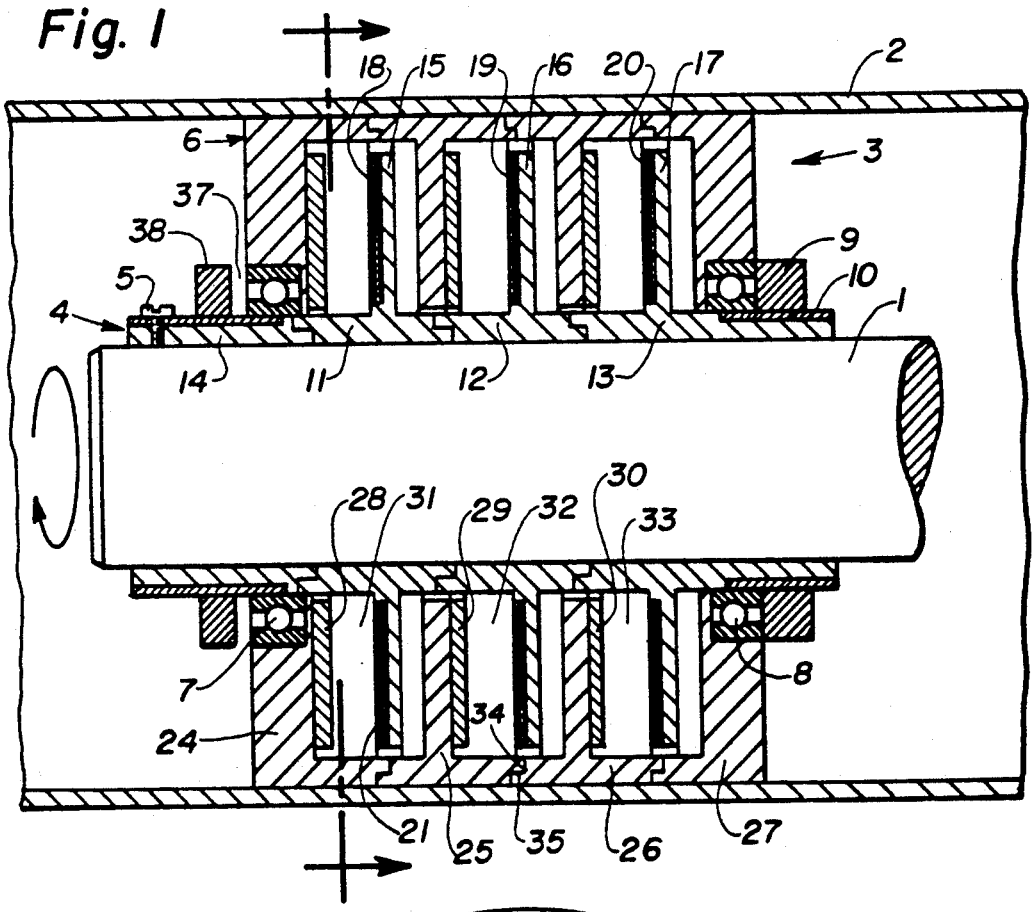
FIG. 1 is a longitudinal elevation view, partly in cross-section, of a torque-transmission device utilized in the present invention.
Figure 2:
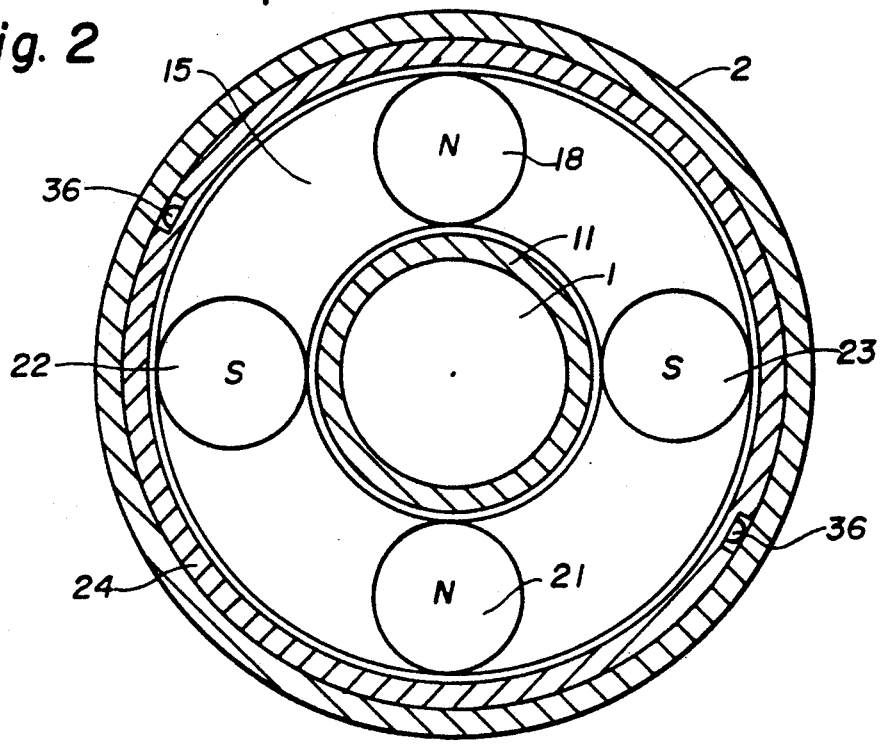
FIG. 2 is a cross-sectional view taken along line II—II of FIG. 1.

FIGS. 1 and 2 show a torque-transmission device 3 positioned between a reel axle 1 and a reel core 2. The torque-transmission device 3 has a hub element 4, which is attached to the reel axle 1 in the axial and rotation directions by means of a screw 5 or another attachment fixture. The torque-transmission device 3 also has a core-receiving element 6, which is movable with respect to the hub element 4. The core-receiving element 6 is positioned on the hub element 4 by means of bearings 7, 8. The core-receiving element 6 can be slid in the axial direction with respect to the hub element 4 by means of an adjusting ring 9, which can be screwed onto a thread 10 at one end of the hub element 4. After the sliding procedure has been completed, the core-receiving element remains in the set position with respect to the hub element 4.

The hub element 4 has three hub modules 11, 12, 13 and an end piece 14. Each hub module 11, 12, 13 has a carrier disk 15, 16, 17, on which permanent magnets 18, 19, 20 are positioned. The individual magnets have an approximately circular cross-section and they are made, for example, of SECOLIT TM, a material manufactured by the Thyssen Company. The permanent magnets 18, 19 and 20 can also be replaced by electromagnets. Several magnets 18, 21, 22, 23, preferably at least four, are positioned on a carrier disk 15, 16, 17. The magnets are oriented in such a way that the main direction of the magnetic field they generate runs approximately parallel to the reel axle 1. The magnets are arranged alternately, that is, their north magnetic poles and south magnetic poles are connected alternately in the direction of the circumference of the carrier disk, 15, 16, 17. The carrier disk 15, 16, 17 itself is made of soft iron or of another material that conducts magnetic forces well, and it more or less short-circuits the magnetic field between the individual permanent magnets 18, 21, 22, 23.

The core-receiving element 6 has three core-receiving modules 24, 25, 26 and an end piece 27. Each core-receiving module 24, 25, 26 has an induction disk 28, 29, 30, which is positioned across from the carrier disks 15, 16, 17. The induction disks are made, for instance, of OERSTIT TM 120, manufactured by the Thyssen Company. There is an air gap 31, 32, 33 between each of the induction disks 28, 29, 30 and the carrier disks 15, 16, 17. When the core-receiving element 6 is slid, for example, to the left with respect to the hub element 4 by means of the adjusting ring 9, the air gaps 31, 32, 33 increase and the transmitted torque decreases. Conversely, the air gaps decrease when the core-receiving element 6 is slid, for example, to the right with respect to the hub element 4 by means of the adjusting ring 9. For the sake of clarity, the figure shows the air gaps greatly enlarged. The movement of the core-receiving element 6 towards the left is limited by a stopper 38. The larger the air gaps 31, 32, 33 are, the smaller a gap 37 between the core-receiving element 6 and the stopper 38 is. The proper setting of the air gap can be checked by measuring the width of the gap 37, for example, with a simple distance or thickness gage. The air-gap width can also be ascertained by measuring the distance between the front of the adjusting ring 9 and the front of the hub element 4. It is also possible to calibrate the torque-transmission device 3, for example, by marking a certain position on the adjusting ring 9 and by affixing a scale to the hub element 4. Here, each angle position of the adjusting ring 9 corresponds to a pre-specified air-gap length. On the basis of the diagram in FIG. 4, it can be seen that each air-gap length corresponds precisely to a transmitted torque. The various curves in FIG. 4 relate to different magnetic strengths or magnetic values on the carrier disk.

The torque-transmission device 3 is even functional with just one module, in which, for instance, the hub element 4 consists of the hub module 13 and of the end piece 14, while the core-receiving element 6 consists of the core-receiving module 24 and the end piece 27. The modules have an external thread 34 on one end and an internal thread 35 on the other end, with which they can be screwed to each other. The thread can be secured against accidental opening by conventional methods. First of all, this connection ensures that smooth surfaces are formed from the core-receiving element 6 and from the hub element 4, so that the reel axle 1 can easily be inserted and the reel core 2 can easily be slid into place. Secondly, this connection also makes it possible to transmit the axial movement of one module to the other module. Consequently, just one adjusting ring 9 is sufficient to activate all of the modules.

The dimensions of the spaces between the back of the carrier disks 15 and 16 and the back of the induction disks 29 and 30 of the following module are selected in such a way that the magnetic field of the permanent magnet 18, for example, cannot affect the induction disk 29. This is achieved, on the one hand, in that the carrier disk 15 consists of a material which conducts magnetic forces well and which practically short-circuits the magnetic field and, on the other hand, in that a certain minimum distance is maintained between the carrier disk 15 and the induction disk 29 of the following module.

The range of the transmittable torque of a given module can be varied by adjusting the air gap between a minimum and a maximum value. The maximum value is preferably at least twice as much as the minimum value. This makes it possible to continuously adjust the torque over a very wide range. If the torque that can be transmitted by one module in its maximum setting is no longer sufficient, one can simply use two modules, which can then be operated at their minimum setting. However, in a preferred embodiment, the setting range of one single module is substantially greater. Here, the maximum transmittable torque of a module is more than eight times greater than the minimum transmittable value.

The winding device can also be equipped with a setting mechanism which actuates the adjusting ring 9 during operation, that is, when the reel axle is rotating and which continuously, or at intervals, changes the air gaps 31, 32, 33 by means of the adjusting ring. If the air gaps are not changed, the torque on the reel core 2, and thus the torque transmitted to the reel, remains constant. Therefore, the tension decreases as the diameter of the reel increases. In general, this is a desired effect. However, in special cases, where the tension is to remain constant throughout the entire reel, it is necessary to change the transmitted torque as a function of the diameter of the reel. The drive motor (not shown here) of the reel axle 1 has a back-run suppressor. The wound width of material is braked by a material brake when this motor is stopped. Since the torque-transmission device 3 transmits a torque even when it is standing still, the reel cannot unwind backwards. Therefore, a constant tension is maintained even at a standstill. This gives rise to a relatively uniform winding level.

The reel core 2 is held on the core-receiving element 6 by means of a conventional adjustable holding mechanisms 36, shown in FIG. 2. After this holding mechanism has been released, the reel core 2 can easily be removed from the core-receiving element 6. If several torque-transmission devices 3 are positioned on the reel axle 1, they all have the same diameter so that the reel cores can be easily moved past each torque-transmission device 3. In the case of a change in the cutting program, that is, when the widths of the individual wound strips of material are to be varied, all that is necessary is to loosen the screw 5, to slide the torque-transmission device 3 in the axial direction along the reel axle 1 and, if necessary, to set the new torque. This can be done on the shaft.

Figure 3:
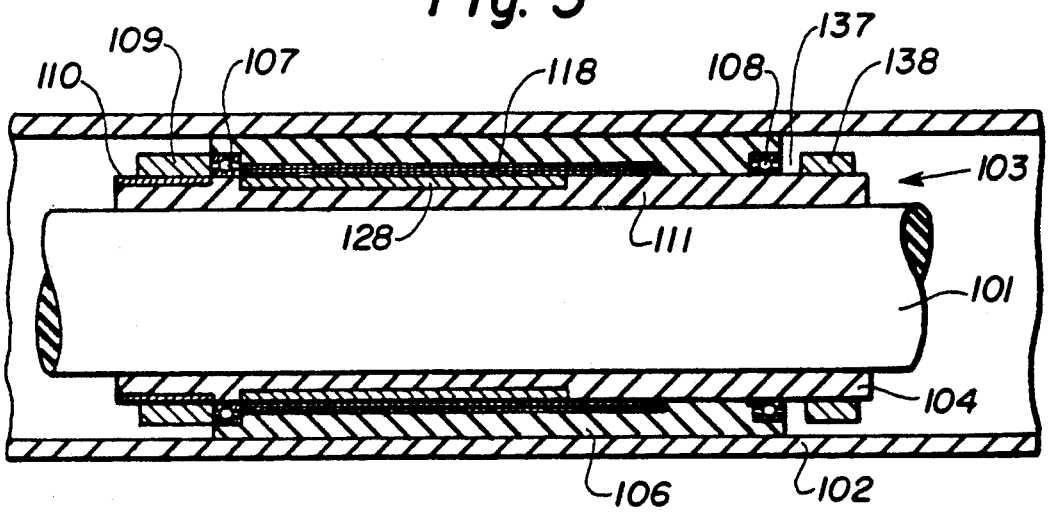
FIG. 3 is a longitudinal elevation view, partly in cross-section, of another torque-transmission device utilized in the present invention.

FIG. 3 shows another embodiment, which is especially well suited for reel cores that have a small diameter. Elements which correspond to those in FIG. 1 have 100 added to the reference number. A torque-transmission device 103 is positioned on the reel axle 101 onto which a reel core 102 is slipped and attached in a commonly known manner. The torque-transmission device 103 has a core-receiving element 106 and a hub element 104 attached to the reel axle 101. The core-receiving element 106 is positioned rotatably on the hub element 104 by means of bearings 107, 108, and it can be slid in the axial direction by means of an adjusting ring 109 which can be turned on a thread 110.

The core-receiving element 106 has permanent magnets 118. However, the main direction of the magnetic field does not run in the axial direction, but rather in the radial direction. Here, too, the permanent magnets are again arranged alternately, that is, a north magnetic pole, a south magnetic pole, a north magnetic pole, etc., alternately point in the direction of the reel axle 101. The hub element 104 consists mainly of a material 111 that does not conduct magnetic and electrical forces, to which no forces can be transmitted by the magnetic field. Only in one axial section is there an induction layer 128 upon which the magnetic field can exert its forces. By sliding the core-receiving element 106 in the axial direction with respect to the hub element 104, it is possible to change the covered area of the permanent magnet 118 with the induction element 128. This also changes the magnetic coupling. The greater the covered area between the permanent magnet 118 and the induction element 128, the greater the transmittable torque is.

The radial air gap between the hub element 104 and the core-receiving element 106 cannot be seen in FIG. 3. In order to achieve as good a magnetic coupling as possible, efforts are made to keep this air gap as small as possible. In extreme cases, it is sufficient to position both elements very closely together, but without any actual contact between them. Here, too, it is possible to ascertain the set torque after calibrating the width of the gap 137 between the core-receiving element 106 and the stopper 138 which is rigidly located on the hub element 104.

In the case of FIG. 1, the device to generate the magnetic field can also be positioned in the core-receiving element 6, whereas the induction disks then belong to the hub element 4. Likewise, the permanent magnets in FIG. 3 can also be positioned on the hub element 104 when the induction element 128 is positioned on the core-receiving element 106.

Figure 4:
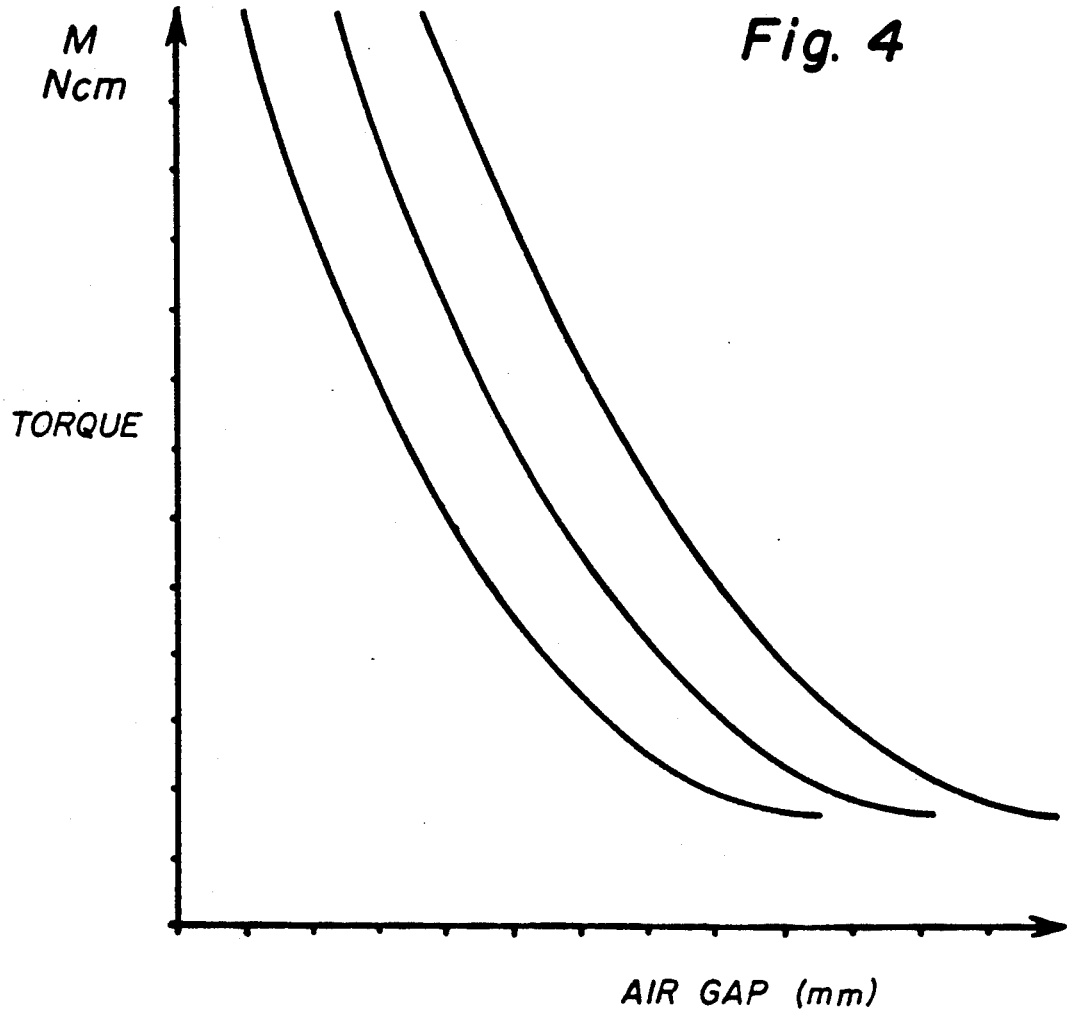
FIG. 4 is a graph of characteristic curves for three different embodiments showing transmitted torque versus air-gap length.

FIG. 4 shows a group of curves for three different embodiments, in which the left-hand curve has four permanent magnets, the curve in the middle has six permanent magnets and the right-hand curve has eight permanent magnets on the carrier disk. This shows that the relationship between the transmitted torque and the air-gap length is virtually linear over a wide section of the range.

The transmission of the torque by means of a magnetic field eliminates all of the friction that could lead to the formation of dust. Therefore, the winding device according to the invention can also be used under clean-room conditions. The torque-transmission device is positioned between the reel axle and the reel core, so that it is not necessary to waste any space on the reel axle for any friction surfaces. Spacing tubes are no longer necessary since the hub element can be affixed on the reel axle in the axial direction as well. Consequently, all that is necessary to change the cutting program is to axially slide each torque-transmission device on the reel axle in order to place it in a position which is suitable to receive a reel core. It is, of course, also possible to install idling torque-transmission devices in the spaces between individual reel cores in order to have reserve positions to hold additional reel cores. As a consequence, it becomes possible to change not only the cutting program with respect to the width of the individual strips of material, but also to vary the number of strips without the need for a complete retooling of the reel axle.

The torque-transmission device is designed in a very compact form. An operator can handle this device as a single unit which only has to be slid onto the reel axle and fixed there. Subsequently, the reel core can be slipped onto the torque-transmission device. As a result, the set-up time for retooling the reel axle can be cut down to a fraction of the time that was needed until now. Thus, the speed of the production process is considerably increased. The change times during the normal production process, that is, removing the reels that have been wound full and installing empty reels, are also shorter, since the reel cores merely have to be moved past the torque-transmission devices. Very uniform levels of tension can be maintained. External factors, such as heat, dust, starting acceleration and braking have a practically negligible effect on these tension values. Any irregularities in the drive control are compensated for, since the magnetically transmitted torque is independent of the drive speed over a wide range. This means that fairly inexpensive drives and controls can be used, because precise regulation of the speed and torque of the reel axle is not necessary. In addition to cutting purchase costs, this also simplifies the maintenance and operation of the drive. The torque-transmission device is virtually maintenance-free. It has an extremely long service life since, aside from bearings, it does not have any movable parts that touch each other mechanically and moreover, it has no wearing parts. The conventional winding device can be converted into a winding device according to the invention by simply retooling it with the new torque-transmission device.

In a preferred embodiment, the magnetic coupling between the hub element and the core-receiving element is variable. Therefore, it is possible to adjust the force which is exerted by one part upon the other part and which is responsible for torque transmission. Consequently, the desired torque can be adapted to different widths of the strips of material. A greater torque is needed for a wider strip of material than for a narrower one if both strips are to be wound with the same tension. Due to these adjustment possibilities, only a small number of torque-transmission devices has to be kept on hand. The set tension values, that is, the set torques, can be maintained with very small deviations. Measurements have showed that the deviations lie under 5%. The set values can be monitored with simple tension scales, for example, spring-type scales. Of course, it is also possible to carry out a calibration procedure of the torque-transmission device prior to its initial use and to record the values thus obtained in a scale diagram.

Advantageously, the main direction of the magnetic field runs parallel to the reel axle in the device that generates the magnetic field. The device to generate the magnetic field consists of several permanent magnets or electromagnets which can be positioned at a certain distance from the reel axle, also in the radial direction. This enables the transmission of a great torque, even with relatively weak magnetic fields. The device to generate a magnetic field can have, for instance, electromagnets. However, in a preferred embodiment, this device has permanent magnets. This eliminates the need to supply electricity to the reel axle. It is possible to determine the torque range for each torque-transmission device by using magnets of different strengths or by changing the number of magnets.

In the preferred embodiment, the device to generate the magnetic field is arranged on a carrier disk positioned perpendicularly to the reel axle, and the magnetic field acts upon an induction disk positioned parallel to the carrier disk, whereby the carrier disk is rigidly connected to the hub element or to the core-receiving element and the induction disk is rigidly connected to the other part, while there is an air gap between both disks. Due to the induction disk, a counterpart is present in practically every position of the device that generates the magnetic field, a counterpart upon which the magnetic field can act. There are no interruptions in the counterpart that could lead to stop-moments. The air gap serves to linearize the transmission characteristics of the torque-transmission device and the ensure a contact-free relative movement between the carrier disk and the induction disk. For this purpose, the induction disk is made of a material which is subject to magnetic attraction and which resists a change in the magnetic field on the basis of its magnetic and/or electric properties. In order to maintain the field created by the magnets as uniform as possible, the induction disk follows the rotation of the carrier disk.

Advantageously, the air gap can be adjusted. A change in the air gap, which in turn changes the transmitted torque and the tension, is possible while the torque-transmission device is disposed on the reel axle. However, the strength of the torque to be transmitted can also be set prior to sliding the torque-transmission device onto the reel axle. This is especially advantageous when the material to be wound is light-sensitive, such as photopolymer films or photographic silver-halogenide films. In such cases, the winding operations must take place in a dark area. Nevertheless, setting the torque can be done outside the dark area, which enables substantially higher precision of the setting procedure and greatly simplifies the operation. The width of the air gap is easy to measure, so that the setting of the correct torque can easily be checked with a thickness gage. As a result, the set-up times for setting the torque are very short.

In an especially preferred embodiment, the torque-transmission device has a modular design, whereby each module has a hub element, a core-receiving element and a device that generates a magnetic field. This simplifies stocking various torque-transmission devices. Basically, it is sufficient to stock one type of torque-transmission device with a certain number of modules.

If a greater torque is desired, two modules are simply connected to each other. Since, as a rule, greater torque is only desired for wider strips of material, this poses no problem in terms of space. Advantageously, all of the modules contribute equally to the torque transmission. This eliminates the need for complicated calculations. Here it is advantageous if each module can be adjusted over such a wide torque-transmission range that the transmitted torque at its maximum setting is greater than the transmitted torque of two connected modules at their minimum setting.

In the preferred embodiment, the hub elements of all of the modules and the corresponding core-receiving elements are rigidly connected to each other. As a consequence, the operator will only have to handle one device as a single unit, even when several modules are connected to each other. In this context, it is advantageous that the hub elements of all of the modules and the corresponding core-receiving elements of all of the modules are rigidly attached to each other in order to jointly shift in the axial direction. When the air gap has to be adjusted, all that is necessary is to adjust the air gap of one module. On the basis of the axial connection between the individual modules, the air gap of the other modules then adjusts automatically to the desired value. Preferably, the hub elements and the corresponding core-receiving elements are screwed together. For this purpose, the hub element of one module will have, for example, an external thread, while the hub element of the adjacent module will have an internal thread on the adjacent side. This results in a compact exterior. There is no need for flanges or other attachment boreholes, through which screws or other attachment fixtures can be inserted. The thread can be secured against loosening by conventional methods.

In another preferred embodiment of this invention, the main direction of the magnetic field runs radially to the reel axle in the device that generates the magnetic field. This is particularly advantageous when small reels with reel cores that have a small inner diameter are to be wound. Preferably, the core-receiving element completely or partially covers the device that generates the magnetic field, whereby the area covered can be varied. Since the possibility of adjusting the air gap does not exist here, the adjustment of the torque is carried out by means of an adjustment of the area covered.

In an especially preferred embodiment, there is an adjustment device which changes the magnetic coupling during the winding process continuously or at certain intervals, depending on the rotation speed. Without changing the torque, the winding tension slackens as the diameter increases, an effect which is usually desired. In special cases, however, it might also be necessary to maintain the tension constant throughout the entire reel. Then the torque has to be increased as a function of the diameter of the reel. Such an adjustment device can change the air gap by means of, for example, axial pressure or by grasping a screw thread.

Preferably, the drive of the reel axle is advantageously equipped with a back-run suppressor and it also has a brake for the material. This assures an even winding level, even if the winding operation is interrupted, since the winding tension is maintained and there are no irregularities in the winding level when the drive is stopped and re-started. This is especially advantageous when strips of material are being wound, which are in sandwich form, that is, they have a liquid or at least plastic compound between two covering layers. After the winding operation has been completed, these reels are provided with end disks designed to prevent the intermediate layer from squeezing out at the edges. If there are irregularities in the reel, these end disks would not fit tightly enough on the winding level, thus no longer fulfilling their sealing function.

What is claimed is:

1. In a winding device adapted to simultaneously wind several widths of material onto reel cores, the winding device having a driven reel axle on which at least one reel core is rotatably arranged, and having a torque-transmission device to transmit a torque from the reel axle to the reel core, the torque-transmission device having a sliding hub element disposed on the reel axle and a core-receiving element which slides in the reel core and which is affixed in the reel core in the rotating and axial directions, the improvement in the winding device comprising the torque-transmission device (3, 103) being disposed in the radial direction between the reel axle (1, 101) and the reel core (2, 102)

completely inside said reel core (2, 102) wherein the hub element (4, 104) is attached to the reel axle (1, 101) in the axial direction, the torque-transmission device (3, 103) comprising a plurality of torque-transmission modules wherein each torque-transmission module has a hub module (11–13) disposed on the reel axle, a core-receiving module (24–26) which slides in the reel core and which is affixed in the reel core in the rotating and axial directions, and means (18–23, 118) for generating a magnetic coupling field between the hub module (11–13) and the core-receiving module (24–26) sufficient to transmit a torque from the hub module (11–13) to the core-receiving module (24–26), said hub modules (11–13) and said core-receiving modules (24–26) of adjacent torque-transmission modules being screwed together rigidly, respectively, to form said sliding hub element and said core-receiving element, so as to allow for shifting in the axial direction jointly, said generating means including means for changing the magnetic coupling field between each hub module (11–13) and its associated core-receiving module (24–26) by jointly shifting said core-receiving modules (24–26) axially, thereby jointly changing the magnetic coupling between each hub module (11–13) and the adjacent core-receiving module (24–26).

2. A winding device according to claim 1, wherein the means for generating the magnetic coupling field has permanent magnets (18–23) disposed therein.

3. A winding device according to claim 1, wherein the main direction of the magnetic field runs parallel to the reel axle (1) in the means for generating the magnetic field (18–23).

4. A winding device according to claim 3, wherein the means for generating the magnetic field (18–23) is arranged on a carrier disk (15–17) positioned perpendicularly to the reel axle such that the magnetic field acts upon an induction disk (28–30) positioned parallel to the carrier disk, wherein the carrier disk (15–17) is rigidly connected to the hub element (4) or to the core-receiving element (6) and the induction disk (28–30) is rigidly connected to the core-receiving element (6) or to the hub element (4), respectively, so as to allow an air gap (31–33) between the disks (15–17, 28–30).

5. A winding device according to claim 4, wherein the air gap (31–33) can be adjusted.

6. A winding device according to claim 1, wherein all of the modules contribute equally to the torque transmission.

7. A winding device according to claim 1, wherein the main direction of the magnetic field runs radially to the reel axle (111) in the means (118) for generating the magnetic field.

8. A winding device according to claim 7, wherein the hub element (104) or the core-receiving element (106) covers the means (118) for generating the magnetic field, and wherein the area covered can be varied.

* * * * *